US010910730B2

(12) United States Patent
Bachmann

(10) Patent No.: US 10,910,730 B2
(45) Date of Patent: Feb. 2, 2021

(54) ATTACHABLE ANTENNA FIELD DIRECTOR FOR OMNIDIRECTIONAL DRONE ANTENNAS

(71) Applicant: Helmuth G. Bachmann, Salinas, CA (US)

(72) Inventor: Helmuth G. Bachmann, Salinas, CA (US)

( * ) Notice: Subject to any disclaimer, the term of this patent is extended or adjusted under 35 U.S.C. 154(b) by 278 days.

(21) Appl. No.: 16/003,025

(22) Filed: Jun. 7, 2018

(65) Prior Publication Data

US 2019/0379138 A1 Dec. 12, 2019

(51) Int. Cl.
*H01Q 21/24* (2006.01)
*H01Q 1/36* (2006.01)
*H01Q 19/00* (2006.01)

(52) U.S. Cl.
CPC ..... *H01Q 21/24* (2013.01); *H01Q 1/36* (2013.01); *H01Q 19/005* (2013.01)

(58) Field of Classification Search
CPC ..... H01Q 19/005; H01Q 19/30; H01Q 21/24; H01Q 1/24; H01Q 1/36–1/38; H01Q 1/44
See application file for complete search history.

(56) References Cited

U.S. PATENT DOCUMENTS

| | | | | |
|---|---|---|---|---|
| 5,008,681 | A * | 4/1991 | Cavallaro | H01Q 19/005 343/700 MS |
| 5,355,143 | A | 10/1994 | Zurcher | |
| 5,712,643 | A | 1/1998 | Skladany | |
| 6,300,906 | B1 | 10/2001 | Rawnick | |
| 6,307,524 | B1 | 10/2001 | Britain | |
| 6,462,711 | B1 | 10/2002 | Zaghloul | |
| 6,937,192 | B2 | 8/2005 | Mendolia | |
| 7,973,734 | B2 | 7/2011 | Strempel | |
| 8,378,469 | B2 * | 2/2013 | Gaucher | H01L 23/4334 257/674 |
| 8,854,275 | B2 | 10/2014 | Doneker | |
| 9,308,713 | B2 | 4/2016 | Becerril | |
| 10,608,336 | B2 * | 3/2020 | Chen | H01Q 1/48 |
| 2007/0026749 | A1 * | 2/2007 | Cheung | B32B 7/12 441/65 |
| 2013/0106661 | A1 * | 5/2013 | Xiang | H01Q 1/40 343/702 |
| 2016/0087348 | A1 * | 3/2016 | Ko | H01Q 3/247 455/73 |
| 2019/0006751 | A1 * | 1/2019 | Chen | H01Q 21/062 |
| 2019/0115954 | A1 * | 4/2019 | Omori | H01Q 7/00 |

* cited by examiner

*Primary Examiner* — Hasan Z Islam

(57) ABSTRACT

This invention relates to the use of an attachable antenna field director which passively amplifies the signals that are transmitted and received from a drone controller antenna and is comprised of a plurality of director elements embedded in a substantially planar foam body that is pointed in the direction of the drone for maximum amplification.

5 Claims, 2 Drawing Sheets

ATTACHABLE ANTENNA FIELD DIRECTOR FOR OMNIDIRECTIONAL DRONE ANTENNAS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

This invention relates to an attachable antenna field director which passively directs and amplifies the signals that are transmitted and received from a drone controller antenna, providing additional range and/or better video quality and control of a drone behind obstacles. The state of the art designs for passive antenna signal amplifiers or "boosters" are of various designs, which include helical, panel, Yagi and other complete antennas that require the difficult task of dismantling the controller to replace the existing antennas and cables. There is one exception that uses a parabolic reflector or "booster" which mounts onto the existing controller's antennas to reflect the signal onto the antennas. A Yagi antenna that is not intended for drone communications but does have elements mounted on top of a planner surface can be found in U.S. Pat. No. 6,307,524, although it has a driven and reflector element included as with most Yagi antenna designs and is not embedded in the center of a thick material, as in the description for this invention.

BRIEF SUMMARY OF THE INVENTION

It is the object of this invention to disclose the drawbacks of existing prior art for passive antenna signal amplifiers, which require the dismantling of the controller, provide similar performance and are not easily detachable.

It is a further object to the present invention to provide an antenna field director that performs better then an attachable parabolic reflector.

It is a further object to the present invention to provide an antenna field director that is more durable, lighter and takes less space than existing passive antenna signal amplifiers.

It is a further object to the present invention to provide an antenna field director that is easier to visually point accurately in the exact direction of the drone than existing passive antenna signal amplifiers.

BRIEF DESCRIPTION OF THE SEVERAL VIEWS OF THE DRAWING

Corresponding reference numerals designate corresponding parts throughout several views of the drawings.

DETAILED DESCRIPTION OF THE INVENTION

Figure 1:
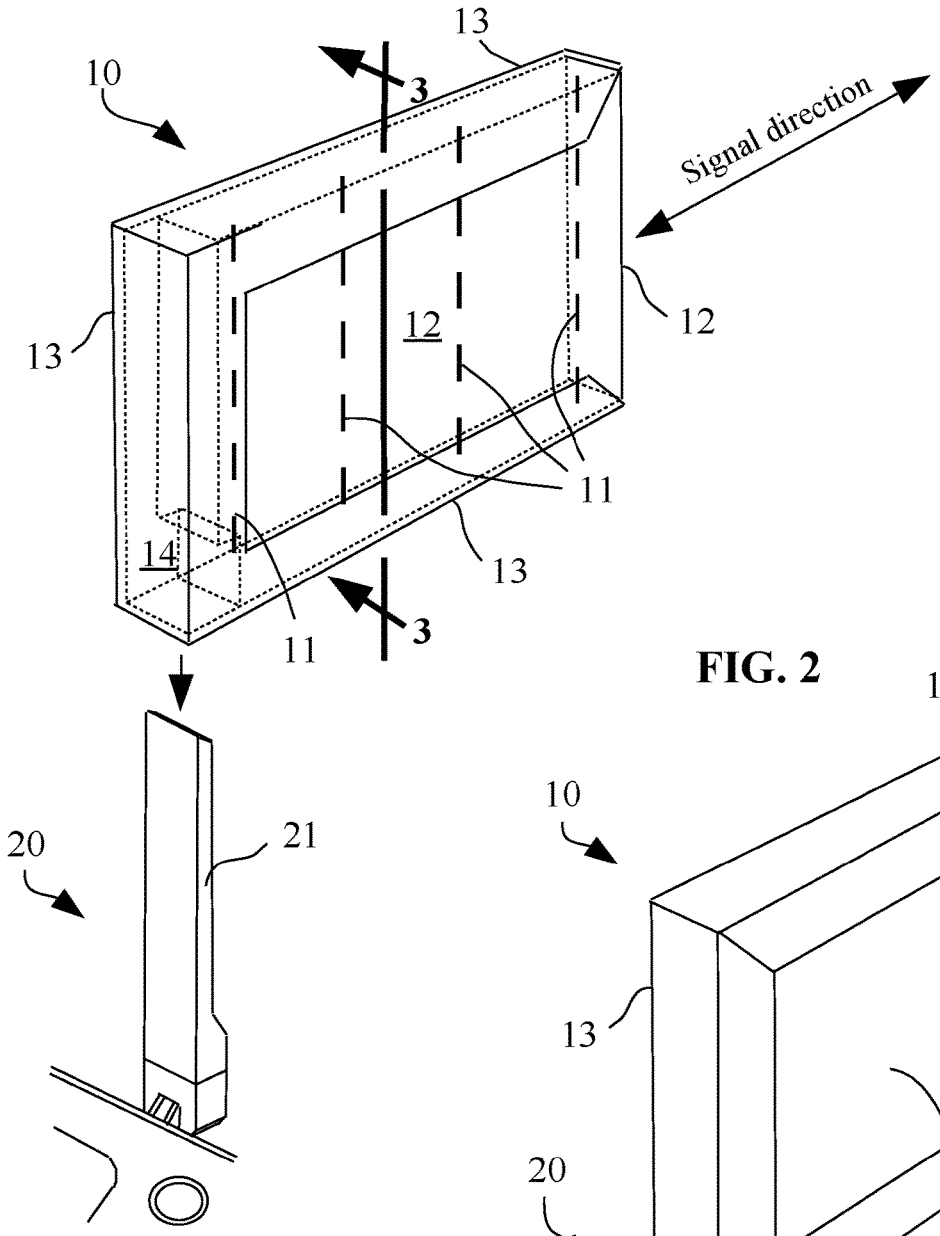
FIG. 1 is a rear perspective view of an antenna field director embodying in the invention and a partial rear perspective view of a controller with antenna.
Figure 2:
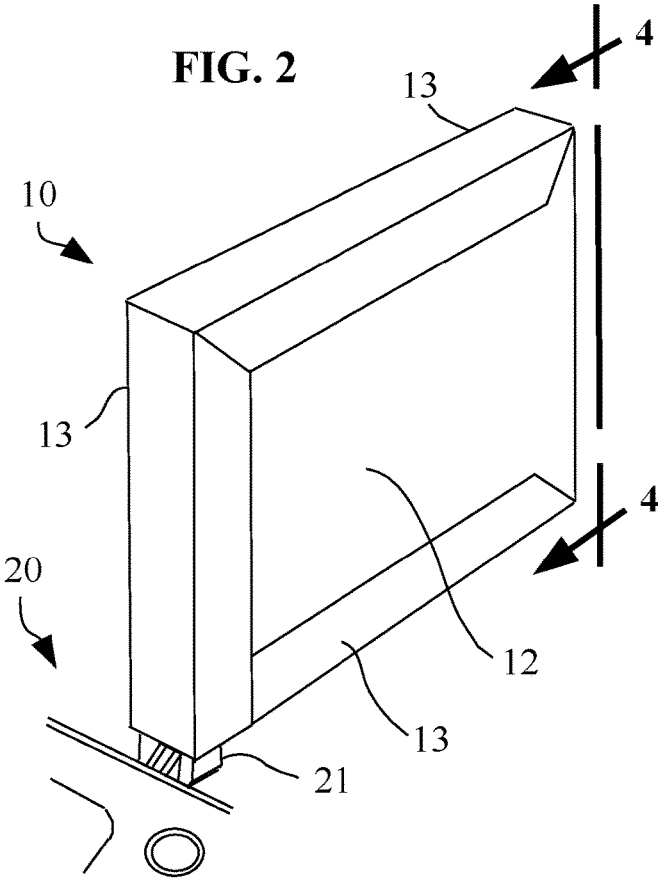
FIG. 2 is a rear perspective view of an antenna field director drone slid onto a drone controller antenna.
Figure 3:
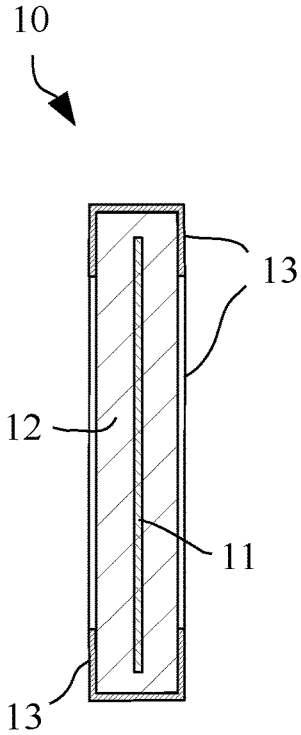
FIG. 3 is a sectional view taken substantially along line 3-3 in FIG. 1 of an antenna field director.
Figure 4:
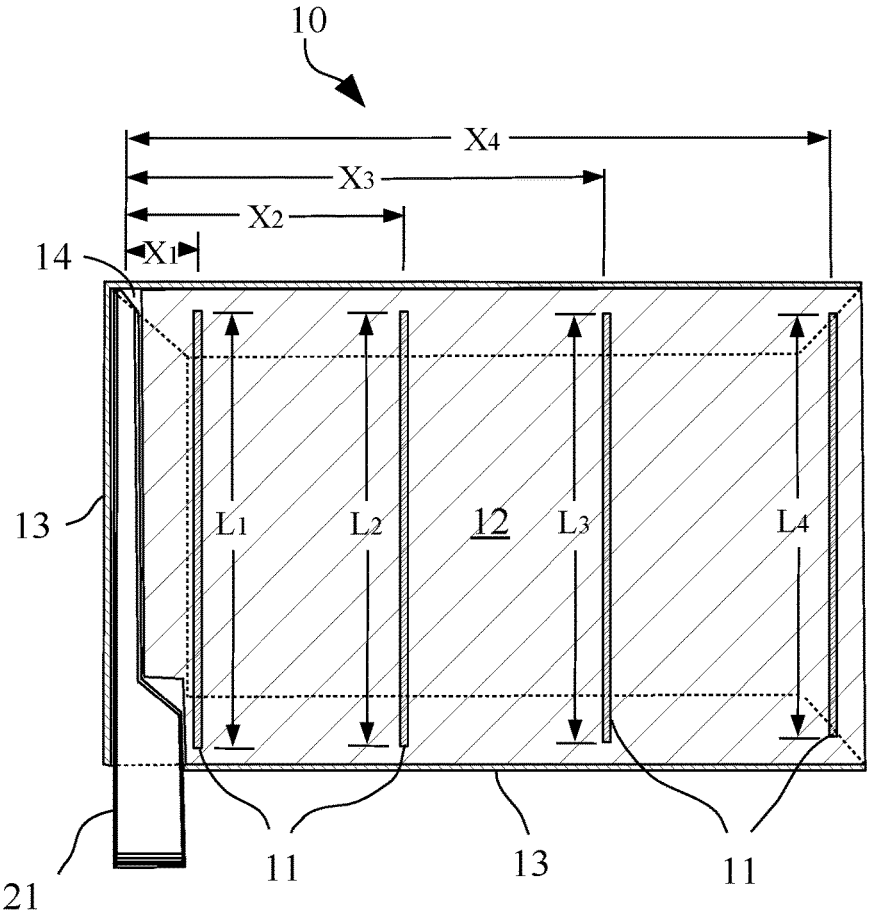
FIG. 4 is a sectional view taken substantially along line 4-4 in FIG. 2 of an antenna field director including a side view of an inserted drone controller antenna.

Referring now to the drawings, and more particularly to FIGS. 1 through 4, an antenna field director 10 for a drone controller 20 with transmitting and or receiving antenna 21 comprised of a plurality of parallel co-planar director elements 11. The director elements 11 are embedded in a substantially planar foam body 12 that extends from the front side of the antenna 21 and is held in place with a plastic support trim 13 which creates a channel 14 that easily slides over and encases a mono-pole, dipole or multi-folded dipole controller antenna 21 at one end. The elements 11 are close to one half the wave length at the high end of the frequency band of the controller 20. The number of elements and their distance from the antenna are maximized to have the highest gain across the entire band with minor adjustments for each particular drone controller 20 receiver/transmitter impedance or antenna 21 length for optimal performance generally using the 2.4 GHz, 5.8 GHz and 902 MHz to 928 MHz bands. As a preferred embodiment for use with the 2.4 GHz band such as the DJI Mavic series, there are four director elements 11 as shown in FIG. 4, each having the following distance from the receiving and transmitting element (not shown) of the antenna 21 in the antenna housing, starting with the closest one: $X_1$=9 mm, $X_2$=31 mm, $X_3$=57 mm and $X_4$=87 mm, with lengths $L_1$=53 mm, $L_2$=51.7 mm, $L_3$=50.3 mm and $L_4$=49 mm respectively. Each element 11 is made of 1.6 mm (1/16") diameter copper or aluminum rod, in which aluminum is more economical (preferably alloy 5356) and provides similar performance as copper. Additional elements 11 can increase the gain, but also narrows the bandwidth or frequency response across the band and reduces portability for use with small portable drones, for the preferred embodiment. Our tests also indicate that any reflector element behind the antenna 21 provides little performance gain because of the Mavic Pro's receiving and transmitting element's flat PCB design with loops (not shown), which also affects the ability of a parabolic reflector to focus properly on the antenna 21, unlike rod-shaped antennas that have a single center line. A reflector element would also reduce portability and interfere with the operation of the controller's sticks.

The use of a low density foam body 12 preferably comprised of a closed cell polyethylene for the containment on the director elements 11 is novel in providing protection for the delicate 1.6 mm (1/16") diameter high conductivity aluminum or copper rods from physical damage or bodily injury, and degradation of performance from bending or moisture/corrosion. Also, there is negligible signal blockage with foam densities less then or equal to 2.2 lb/cu ft. and surrounding outside plastic support trim 13 (preferably made of a PVC U-channel) on the top and bottom of the foam body 12 and the planer structure makes it easier to accurately point the directional field. When in flight the amount of signal augmentation is obvious with drones that implement RSSI such as the DJI Mavic Pro, which displays the signal strength within the DJI Go 4 App from one to five bars for flight control and video (HD, FPV). Generally, the signal strength will go up one bar with the antenna field director 10, increasing the signal strength out 20% or farther in distance, and conversely drop down one bar without the augmenter 10. Signal strength can be further improved in the Go 4 App by switching from automatic to manual custom selection of the frequency bandwidth allocation from 20 MHz to 10 MHz, as long as the interference stays consistent.

The present invention has been fully described by way of example with the accompanying drawings. Various alternations and changes can be made without departing from the spirit and broader aspects of the invention as set forth in the appending claims, which are to be interpreted in accordance with the principles of patent law including the doctrine of equivalents.

I claim:

1. An attachable antenna field director provided for a drone controller having an omnidirectional mono-pole, dipole or multi-folded dipole controller antenna with a front side, said attachable antenna field director including a top side, a bottom side, and further comprising:

a plurality of coplanar director elements embedded inside a substantially planar foam body extending from said front side of said controller antenna and held in place with a plastic support trim which creates a channel over said controller antenna;

wherein said attachable antenna field director slides on and off said controller antenna along said channel, wherein said substantially planar foam body provides protection for said coplanar director elements from physical damage or bodily injury, and wherein said substantially planar foam body makes it easier to accurately point a directional field of said attachable antenna field director.

2. The attachable antenna field director recited in claim 1, wherein said coplanar director elements include four director elements, wherein the four director elements decrease narrowing of a bandwidth or frequency response across a frequency band and increase portability for use with small portable drones with reduced number of said coplanar director elements.

3. The attachable antenna field director recited in claim 1, in which said substantially planar foam body is made of a closed cell polyethylene, wherein said closed cell polyethylene prevents degradation of performance of said coplanar director elements from moisture/corrosion.

4. The attachable antenna field director recited in claim 1, wherein said substantially planar foam body has a density which is less than or equal to 2.2 lb/cu ft., wherein there is negligible signal blockage with the density of said substantially planar foam body less than or equal to 2.2 lb/cu ft.

5. The attachable antenna field director recited in claim 1, wherein said plastic support trim extends along said top side and said bottom side, wherein said substantially planar foam body is supported by said plastic support trim on its outside.

* * * * *